US011206930B2

(12) United States Patent
Chen

(10) Patent No.: US 11,206,930 B2
(45) Date of Patent: Dec. 28, 2021

(54) MULTI-STAGE LINKAGE INTERLOCKING STRUCTURE OF SWING DINING CHAIR

(71) Applicant: NINGBO HAWK ELECTRICAL APPLIANCE CO., LTD, Zhejiang (CN)

(72) Inventor: Jianlun Chen, Ningbo (CN)

(73) Assignee: NINGBO HAWK ELECTRICAL APPLIANCE CO., LTD.

( * ) Notice: Subject to any disclaimer, the term of this patent is extended or adjusted under 35 U.S.C. 154(b) by 0 days.

(21) Appl. No.: 16/993,016

(22) Filed: Aug. 13, 2020

(65) Prior Publication Data

US 2021/0059430 A1 Mar. 4, 2021

(51) Int. Cl.

| | |
|---|---|
| ***A47D 1/10*** | (2006.01) |
| ***A47D 13/10*** | (2006.01) |
| ***A47D 1/08*** | (2006.01) |
| ***A47D 1/00*** | (2006.01) |
| ***A47D 1/04*** | (2006.01) |

(52) U.S. Cl.
CPC ..... *A47D 1/08* (2013.01); *A47D 1/002* (2013.01); *A47D 1/04* (2013.01); *A47D 13/105* (2013.01)

(58) Field of Classification Search
CPC ..... A47D 13/105; A47D 1/08; A47D 1/002; A47D 1/04
See application file for complete search history.

(56) References Cited

U.S. PATENT DOCUMENTS

2001/0028184 A1* 10/2001 Sitarski ..... A47D 13/105 297/118
2010/0227375 A1* 9/2010 Vind ..... C12N 9/20 435/198
2010/0320810 A1* 12/2010 Chen ..... A47D 1/08 297/118

* cited by examiner

*Primary Examiner* — Sarah B McPartlin

(57) ABSTRACT

A multi-stage linkage interlocking structure of a swing dining chair comprising a swing arm and a chair body. The chair body comprises a seat and a backrest. A multi-stage included-angle adjustment device is arranged between the seat and the backrest. The swing arm is provided with a mounting base, and the seat is rotatably connected with the mounting base. A first locking device is arranged between the seat and the mounting base for locking the seat. The seat is provided with a second locking device for locking the first locking device. A sliding connection rod in linkage with the backrest is provided for unlocking the second locking device. A third locking device in linkage with the mounting base and interacting with the multi-stage included-angle adjustment device is arranged between the seat and the mounting base. The present disclosure has a simple structure, achieves convenient operation and safety, and avoids mal operation.

9 Claims, 6 Drawing Sheets

MULTI-STAGE LINKAGE INTERLOCKING STRUCTURE OF SWING DINING CHAIR

TECHNICAL FIELD

This disclosure generally relates to the technical field of children's dining chairs, and more particularly, to a multi-stage linkage interlocking structure of a swing dining chair.

BACKGROUND

Presently, children's swings and dining chairs have become the necessities during the children's growth. To save cost, conventional swing dining chairs are designed to be transformable between a swing and a dining chair. Namely, when a swing for children's entertainment is wanted, it may be transformed into a swing, and when a dining chair for children's eating is wanted, it may be transformed into a dining chair. Normally, the seat portion and the backrest of the swing dining chair form an adjustable included angle ranging from 95° to 180°. However, when used as a swing, if the included angle formed between the seat portion and the backrest is excessively large, a child may be easily thrown out of the swing, resulting in a poor use safety. Moreover, as most of the conventional swing dining chairs are lack of safe and reliable locking structures, hidden dangers may be caused by the maloperation during use.

SUMMARY

The purpose of the present disclosure is to provide a multi-stage linkage interlocking structure of a swing dining chair, which has a simple structure, achieves convenient operation and high safety, and avoids the maloperation.

To achieve the above purpose, the present disclosure adopts the following technical solution: a multi-stage linkage interlocking structure of a swing dining chair comprising swing arms and a chair body, wherein the chair body further comprises a seat portion and a backrest, and the seat portion is rotatably connected with the backrest, wherein a multi-stage included-angle adjustment device is arranged between the seat portion and the backrest, and the multi-stage included-angle adjustment device is used for adjusting the position of the backrest relative to the seat portion, thereby enabling the seat portion and the backrest to stay at multiple included-angle stages, wherein the included-angle stages comprise a swing included-angle stage and a non-swing included-angle stage, wherein the swing arm is provided with a mounting base, and the seat portion is rotatably connected with the mounting base, wherein the seat portion possesses at least a first angle position and a second angle position relative to the mounting base, wherein a first locking device is arranged between the seat portion and the mounting base for locking the seat portion such that the seat portion is relatively fixed with the mounting base, wherein the seat portion is provided with a second locking device for locking the first locking device, wherein a sliding connection rod is arranged on the seat portion for unlocking the second locking device, and the sliding connection rod is in linkage with the backrest, wherein when the backrest is adjusted to the swing included-angle stage from the non-swing included-angle stage relative to the seat portion, the backrest propels the sliding connection rod to move such that the sliding connection rod propels the second locking device to unlock the first locking device, wherein a third locking device interacting with the multi-stage included-angle adjustment device is arranged between the seat portion and the mounting base, and the third locking device is in linkage with the mounting base, wherein when the first locking device is unlocked and the seat portion rotates from the first angle position to the second angle position relative to the mounting base, the mounting base propels the third locking device to lock the multi-stage included-angle adjustment device, thereby fixing the backrest at the swing included-angle stage relative to the seat portion.

In another aspect of the present disclosure, the first locking device comprises a locking disc arranged on the mounting base and a pulling plate which is arranged on the seat portion and corresponds to the locking disc. A pulling plate sliding groove is formed in the seat portion, and the pulling plate slidably interacts with the seat portion. The locking disc is provided with a locking groove, and the pulling plate is provided with a locking pin. The seat portion is provided with a pulling plate spring matched with the pulling plate. The pulling plate spring abuts against the pulling plate, thus enabling the locking pin to insert into the locking groove.

In another aspect of the present disclosure, the locking disc is provided with a swing positioning groove. The swing positioning groove is located beside the locking groove, and the locking pin interacts with the swing positioning groove in an inserting mode.

In another aspect of the present disclosure, the second locking device comprises a pin hole formed in the pulling plate and a shift pin which is arranged on the seat portion and corresponds to the pulling plate. The shift pin is slidably interacts with the seat portion, and the shift pin is in linkage with the sliding connection rod. The seat portion is provided with a pin spring matched with the shift pin. The pin spring abuts against the shift pin, thus enabling the shift pin to insert into the pin hole.

In another aspect of the present disclosure, the shift pin is provided with an inserting hole for receiving the end portion of the sliding connection rod, and the hole wall of the inserting hole is provided with a pin inclined surface. The end portion of the sliding connection rod is provided with a connection rod inclined surface matched with the pin inclined surface. When the backrest is adjusted to the swing included-angle stage from the non-swing included-angle stage relative to the seat portion, the sliding connection rod moves towards the shift pin, and the connection rod inclined surface abuts against the pin inclined surface, thereby enabling the shift pin to escape from the pin hole.

In another aspect of the present disclosure, the sliding connection rod is provided with a linkage post, and the backrest is provided with a linkage baffle. When the backrest is adjusted to the swing included-angle stage from the non-swing included-angle stage relative to the seat portion, the linkage baffle abuts against the linkage post.

In another aspect of the present disclosure, the third locking device comprises a locking button movably arranged on the seat portion and an inclined surface step which is arranged on the mounting base and abuts against the locking button. When the seat portion is adjusted from the first angle position to the second angle position relative to the mounting base, the inclined surface step pushes the locking button to move, and the locking button extends out from the through-hole, thus locking the positioning pin of the multi-stage included-angle adjustment device. The locking button is provided with a button spring for ensuring that the locking button always possesses a motion tendency of unlocking the multi-stage included-angle adjustment device.

In another aspect of the present disclosure, the multi-stage included-angle adjustment device comprises a stage block arranged on the seat portion, and the stage block is provided with an arc-shaped groove matched with the rotating track of the backrest. A positioning block is movably arranged on the backrest, and a positioning pin in sliding fit with the arc-shaped groove is arranged on the positioning block. The groove wall of the arc-shaped groove is provided with a plurality of stage grooves for receiving the positioning pin, and the plurality of stage grooves are arranged at intervals. A positioning block spring is arranged between the positioning block and the backrest, and the positioning block spring is used for ensuring that the positioning pin always possesses a motion tendency of being clamped into the stage groove.

In another aspect of the present disclosure, the backrest is provided with a pulling cord, which is connected with the positioning block. The arc-shaped groove of the stage block is provided with a through-hole, and the through-hole is formed between the stage groove corresponding to the swing included-angle stage and the stage groove corresponding to the non-swing included-angle stage adjacent to the swing included-angle stage. One end of the locking button far away from the inclined surface step is inserted into the through-hole.

Compared with the prior art, the present disclosure has the following advantages:

Through improving the conventional swing dining chairs, the present disclosure achieves a simple structure and a convenient operation. The multi-stage linkage interlocking structure adopted in the present disclosure is capable of avoiding the maloperation, realizing a safe use and preventing hidden dangers from occurring.

More specifically, through the swing arm arranged on the mounting base, the seat portion is rotatably connected with the mounting base. A first locking device is arranged between the seat portion and the mounting base for locking the seat portion, thus making the seat portion unable to rotate relative to the mounting base. Meanwhile, a second locking device interacting with the first locking device and a sliding connection rod interacting with the second locking device are respectively arranged on the seat portion. When the backrest stays at the non-swing included-angle stage relative to the seat portion, the second locking device locks the first locking device, and the first locking device further locks the seat portion. At this point, the seat portion cannot rotate relative to the mounting base, namely, unable to be transformed into a swing. While the backrest is adjusted to the swing included-angle stage from the non-swing included-angle stage relative to the seat portion, the backrest propels the sliding connection rod to move such that the sliding connection rod propels the second locking device to unlock the first locking device. At this time, the first locking device is in a moving state, allowing a user to transform the dining chair state into the swing state. Furthermore, as a third locking device is arranged between the seat portion and the mounting base, when the backrest stays at the swing included-angle stage relative to the seat portion and the seat portion is adjusted from the first angle position to the second angle position, the third locking device is triggered to act, thus further locking the multi-stage included-angle adjustment device. Therefore, when the swing dining chair is in a swing state, the backrest cannot be adjusted anymore, ensuring that the backrest and the seat portion form a safe included angle.

BRIEF DESCRIPTION OF THE DRAWINGS

In FIGS. 1-10: 1—Swing Arm, 2—Chair Body, 21—Seat Portion, 211—Pulling Plate Sliding Groove, 212—Pin Sliding Groove, 213—Connection Rod Sliding Groove, 214—Guide Post, 22—Backrest, 221—Linkage Baffle, 3—Supporting Frame, 4—Multi-stage Included-angle Adjustment Device, 41—Stage Block, 42—Arc-shaped Groove, 43—Positioning Block, 44—Positioning Pin, 45—Stage Groove, 451—Swing Stage Groove, 452—The First Non-swing Stage Groove, 453—The Second Non-swing Stage Groove, 46—Through-hole, 5—Mounting Base, 61—Locking Disc, 611—Locking Groove, 612—Swing Positioning Groove, 62—Pulling Plate, 612—Locking Pin, 622—Arc-shaped Surface, 71—Pin Hole, 72—Shift Pin, 721—Inserting Hole, 722—Pin Inclined Surface, 8—Sliding Connection Rod, 81—Waist-shaped Hole, 82—Connection Rod Inclined Surface, 83—Linkage Post, 91—Locking Button, 911—Spherical Surface, 92—Inclined Surface Step.

DETAILED DESCRIPTION

Figures are combined hereinafter to further elaborate the technical solution of the present disclosure.

Figure 1:
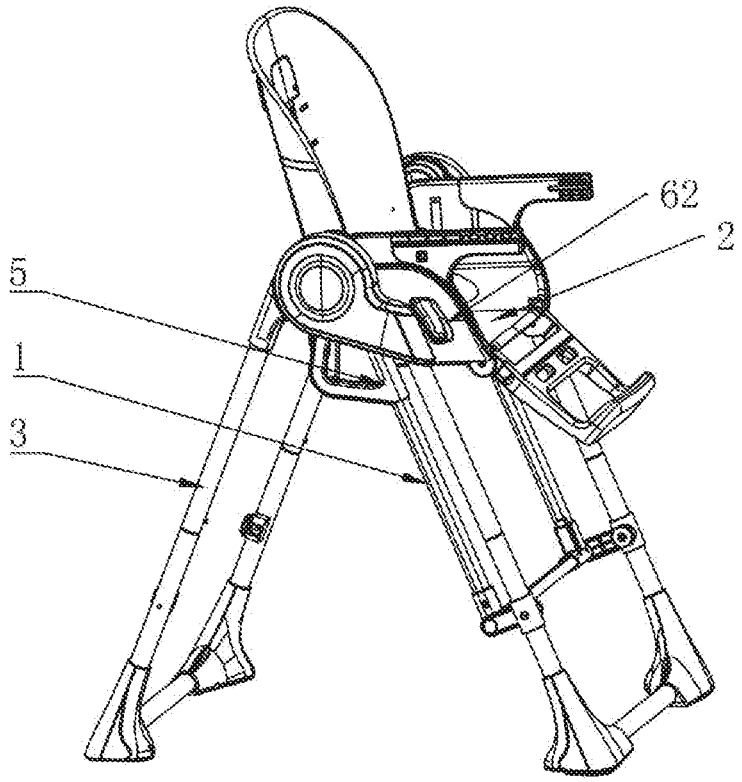
FIG. 1 is conceptual diagram illustrating an overall state of the swing dining chair of the present disclosure when used as a dining chair.
Figure 2:
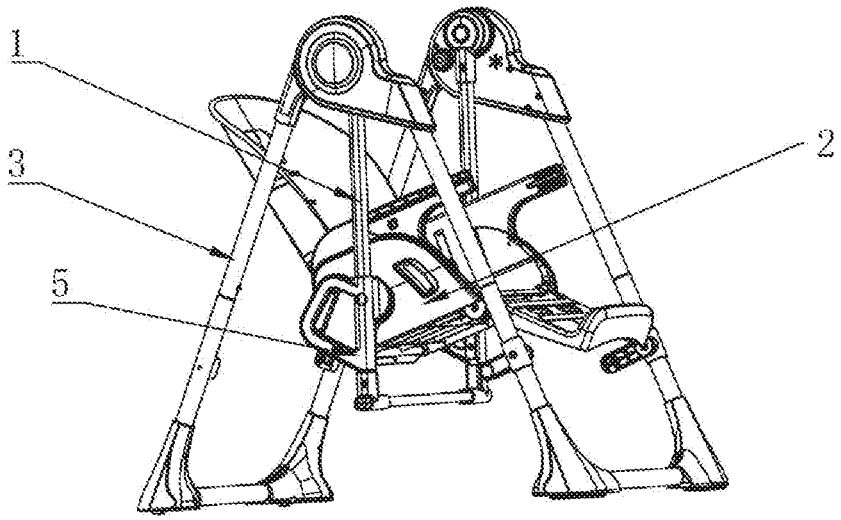
FIG. 2 is conceptual diagram illustrating an overall state of the swing dining chair of the present disclosure when used as a swing.
Figure 3:
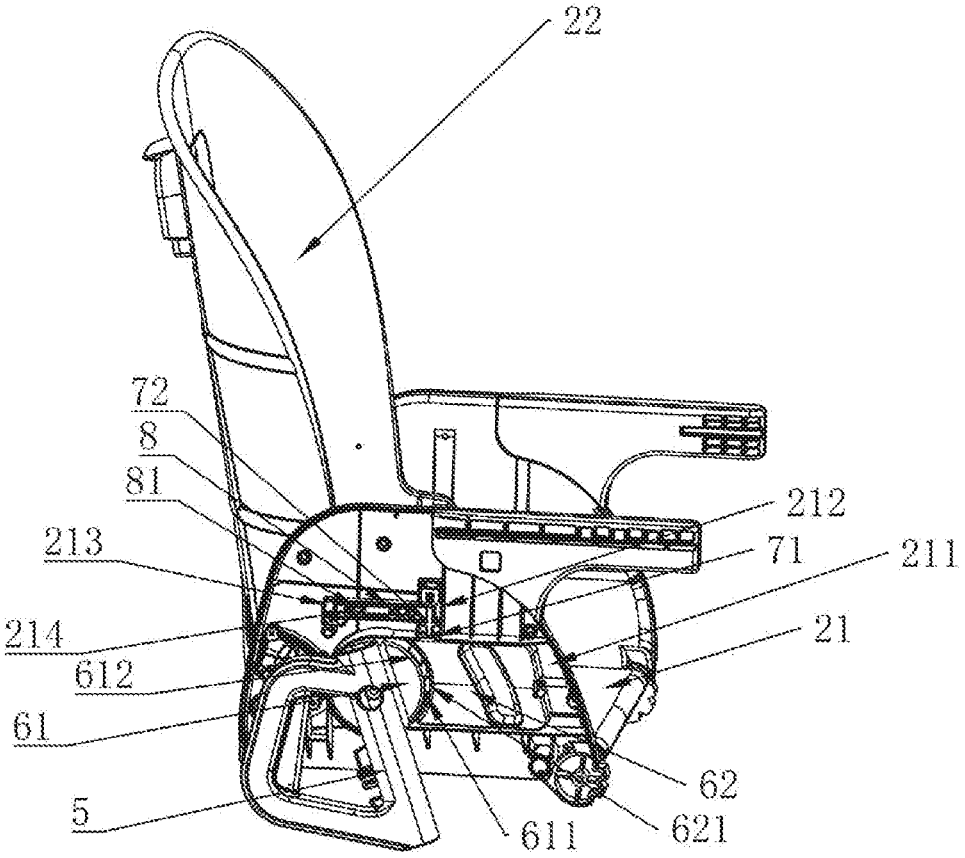
FIG. 3 is a conceptual diagram illustrating an overall structure of the present disclosure.
Figure 4:
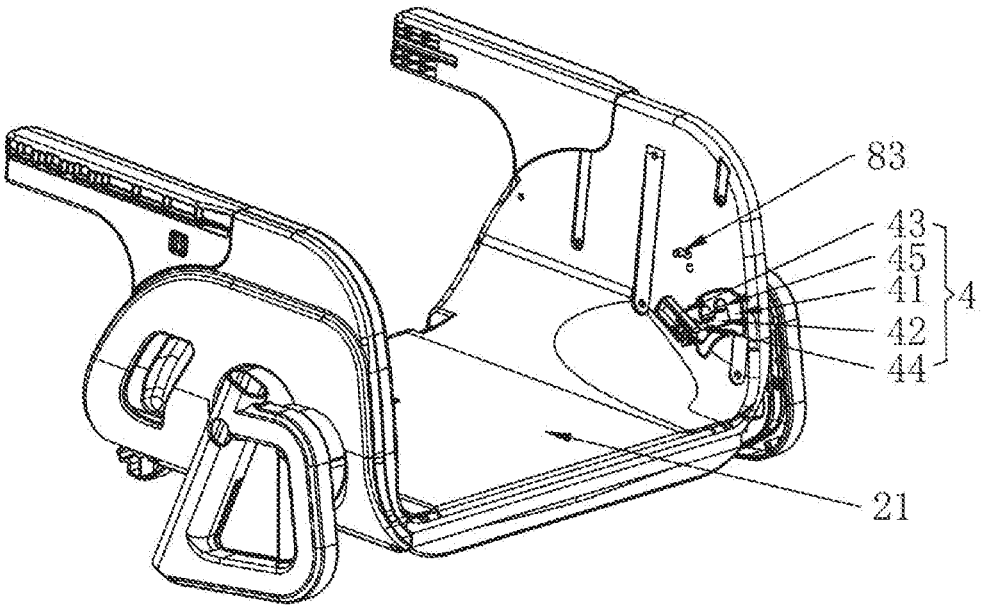
FIG. 4 is a conceptual diagram illustrating an assembled structure of the multi-stage included-angle adjustment device of the present disclosure.
Figure 5:
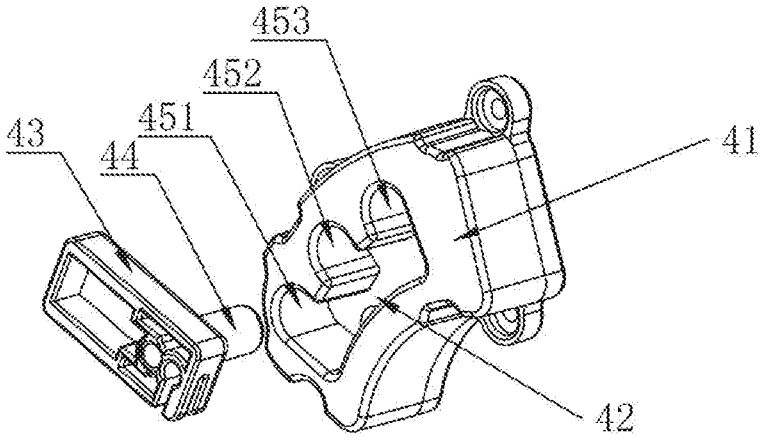
FIG. 5 is a conceptual diagram illustrating a disassembled structure of the multi-stage included-angle adjustment device of the present disclosure.
Figure 6:
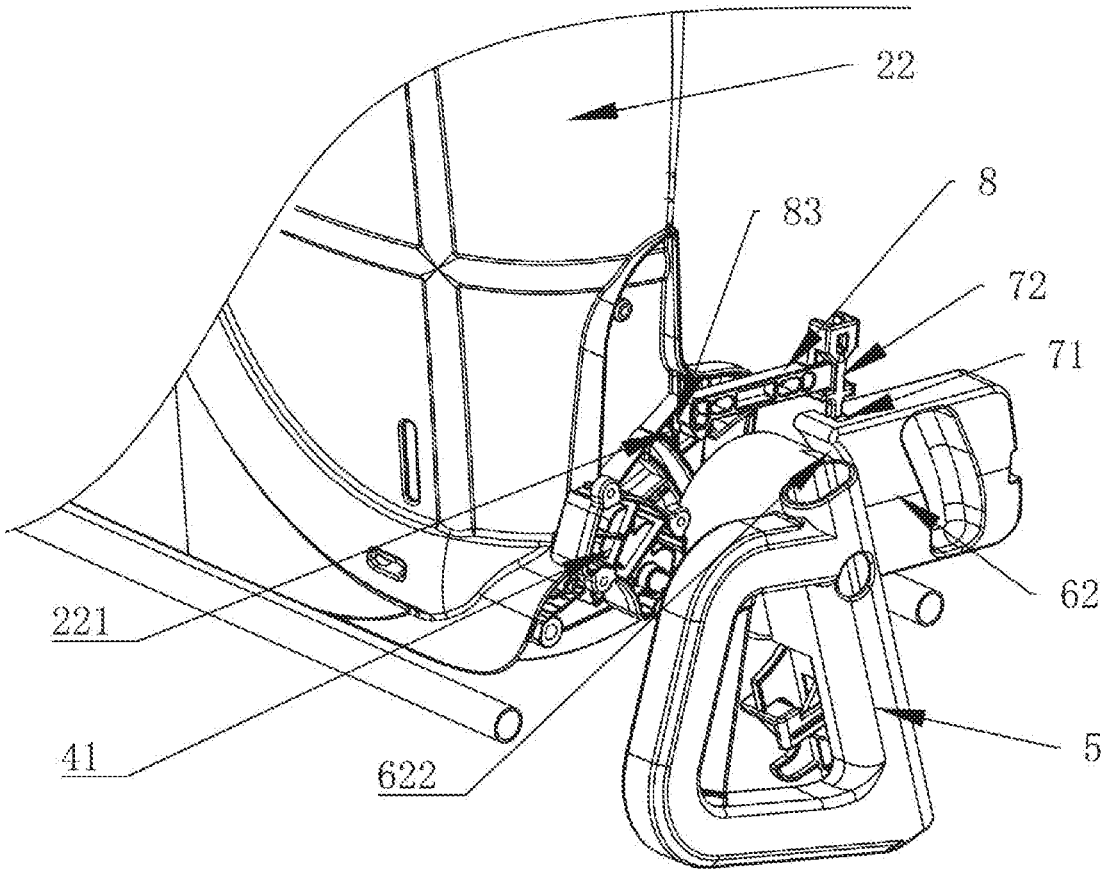
FIG. 6 is a conceptual diagram illustrating an assembled structure of the first locking device, the second locking device and the sliding connection rod of the present disclosure.
Figure 7:
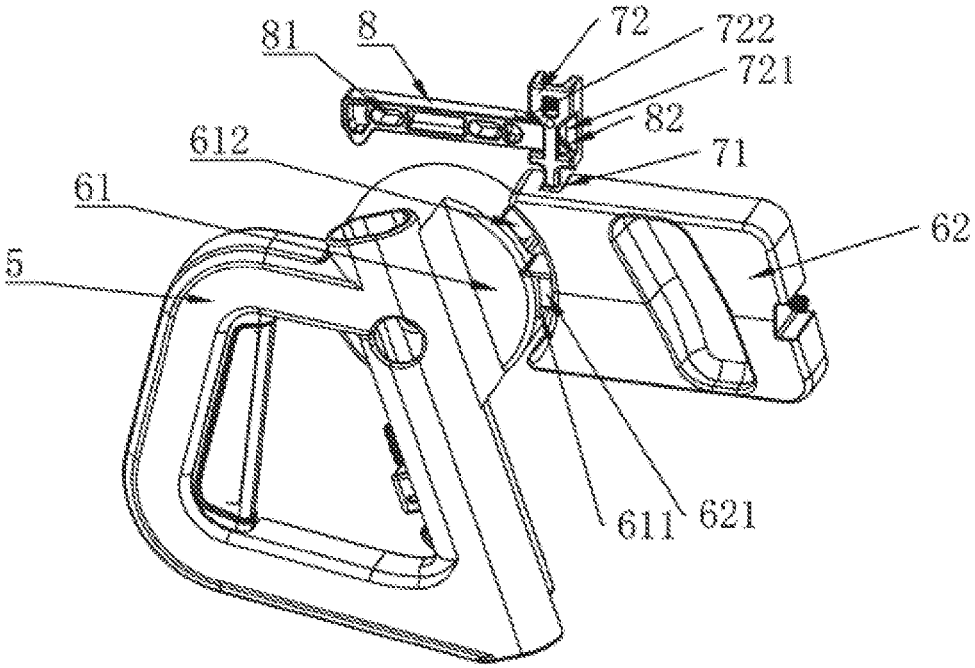
FIG. 7 is another conceptual diagram illustrating an assembled structure of the first locking device, the second locking device and the sliding connection rod of the present disclosure.
Figure 8:
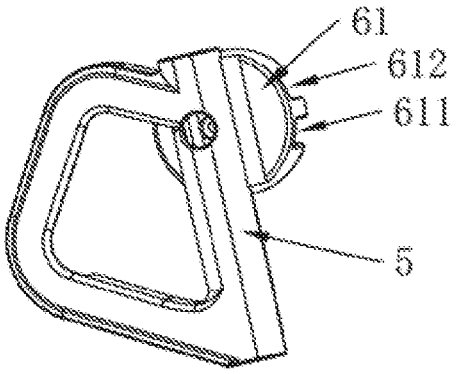
FIG. 8 is a conceptual diagram illustrating an example structure of the mounting base of the present disclosure.
Figure 9:
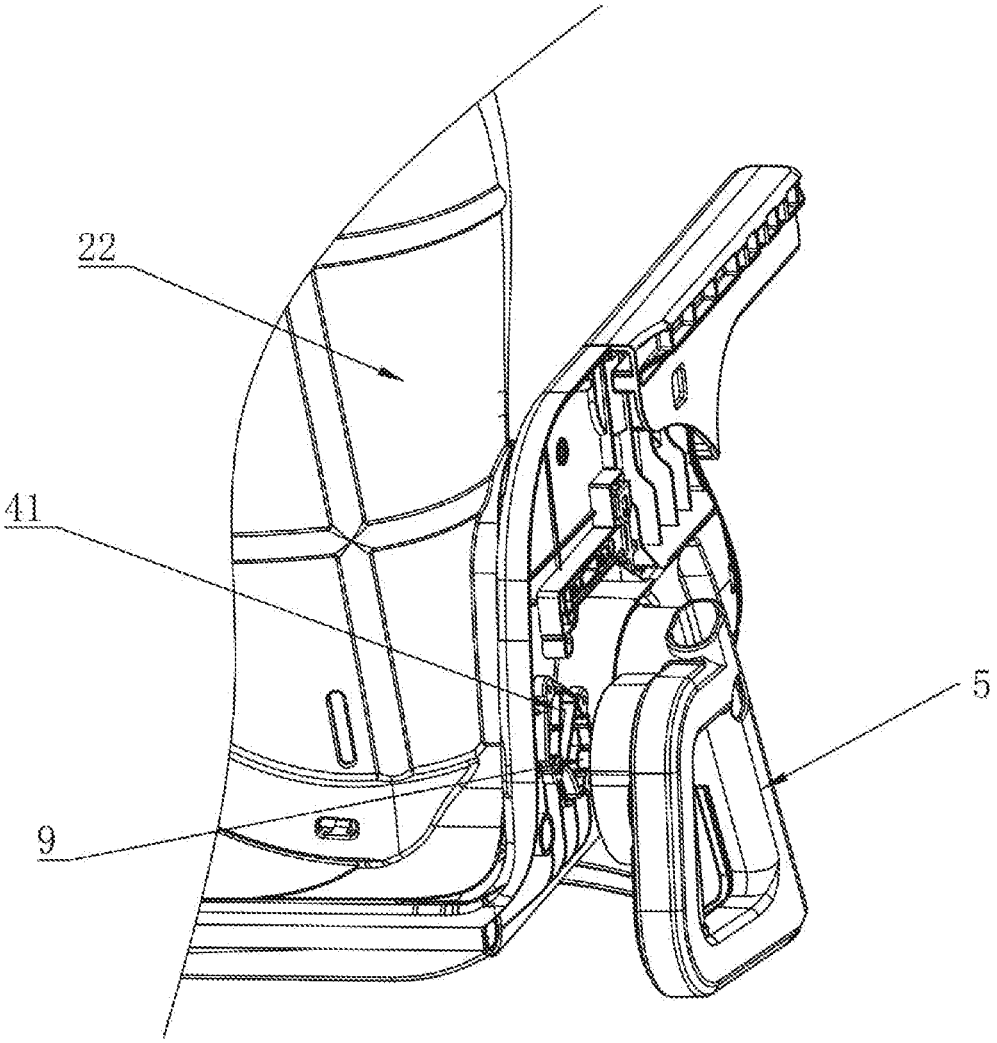
FIG. 9 is a conceptual diagram illustrating an assembled structure of the third locking device and the multi-stage included-angle adjustment device of the present disclosure.
Figure 10:
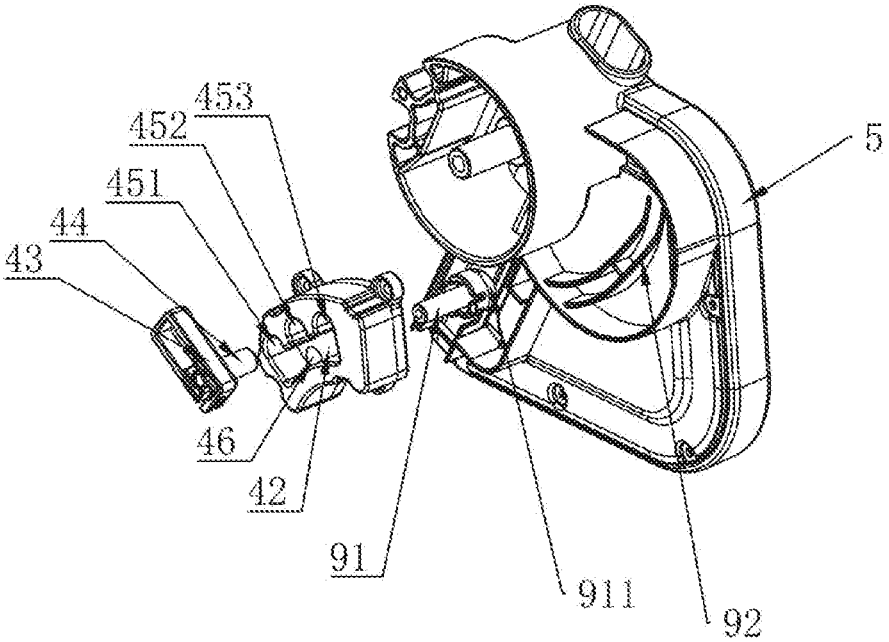
FIG. 10 is a conceptual diagram illustrating a disassembled structure of the third locking device and the multi-stage included-angle adjustment device of the present disclosure.

As shown in FIGS. 1-10, a multi-stage linkage interlocking structure of a swing dining chair comprises swing arms 1 and a chair body 2. The swing arm 1 is mounted on a supporting frame 3 of the swing dining chair. The chair body 2 further comprises a seat portion 21 and a backrest 22, and the seat portion 21 is rotatably connected with the backrest 22. A multi-stage included-angle adjustment device 4 is arranged between the seat portion 21 and the backrest 22, and the multi-stage included-angle adjustment device 4 is used for adjusting the position of the backrest 22 relative to the seat portion 21, thereby enabling the seat portion 21 and the backrest 22 to stay at multiple included-angle stages. The included-angle stages comprise a swing included-angle stage and a non-swing included-angle stage. When staying in the swing included-angle stage, the included angle formed between the backrest 22 and the seat portion 21 is relatively small, and when staying in the non-swing included-angle stage, the included angle formed between the backrest 22 and the seat portion 21 is relatively large.

The multi-stage included-angle adjustment device 4 comprises a stage block 41 arranged on the seat portion 21, and the stage block 41 is provided with an arc-shaped groove 42 matched with the rotating track of the backrest 22. A positioning block 43 is movably arranged on the backrest 22, and a positioning pin 44 in sliding fit with the arc-shaped groove 42 is arranged on the positioning block 43. The groove wall of the arc-shaped groove 42 is provided with a plurality of stage grooves 45 for receiving the positioning pin 44, and the plurality of stage grooves 45 are arranged at intervals.

In this embodiment, the groove wall of the arc-shaped groove 42 is provided with three stage grooves 45, which respectively are a swing stage groove 451, a first non-swing stage groove 452 and a second non-swing stage groove 453. The first non-swing stage groove 452 is located between the swing stage groove 451 and the second non-swing stage groove 453. When the positioning pin 44 is clamped into the swing stage groove 451, the backrest 22 stays at the swing included-angle stage relative to the seat portion 21, and when the positioning pin 44 is clamped into the first non-swing stage groove 452 or the second non-swing stage groove 453, the backrest 22 stays at the non-swing included-angle stage relative to the seat portion 21.

A positioning block spring (not shown) is arranged between the positioning block 43 and the backrest 22, and the positioning block spring is used for ensuring that the positioning pin 44 always possesses a motion tendency of being clamped into the stage groove 45. The backrest 22 is provided with a pulling cord (not shown), which is connected with the positioning block 43.

When the angle of the backrest 22 needs to be adjusted, the pulling cord is pulled to propel the positioning block 43 to slide relative to the backrest 22, thus allowing the positioning pin 44 to escape from the corresponding stage groove 45. At this point, a user may pull the backrest 22 back and forth to make the positioning pin 44 slide in the arc-shaped groove 42. When the backrest 22 is adjusted to a proper position, the pulling cord is released, and the positioning block 43 automatically resets under the action of the positioning block spring. Thus, the positioning pin 44 is clamped into the corresponding stage groove 45. For instance, when the backrest 22 is adjusted to the first non-swing stage, the positioning pin 44 is clamped into the first non-swing stage groove 452.

The swing arm 1 is provided with a mounting base 5, and the seat portion 21 is rotatably connected with the mounting base 5. The seat portion 21 possesses at least a first angle position and a second angle position relative to the mounting base 5, wherein the first angle position is a dining chair state position (shown in FIG. 1), and the second angle position is a swing state position (shown in FIG. 2).

A first locking device is arranged between the seat portion 21 and the mounting base 5 for locking the seat portion 21 such that the seat portion 21 is relatively fixed with the mounting base 5. The first locking device comprises a locking disc 61 arranged on the mounting base 5 and a pulling plate 62 which is arranged on the seat portion 21 and corresponds to the locking disc 61. A pulling plate sliding groove 211 is transversely formed in the seat portion 21, and the pulling plate 62 transversely slidably interacts with the seat portion 21 through the pulling plate sliding groove 211. The locking disc 61 is provided with a locking groove 611, and the pulling plate 62 is provided with a locking pin 621. In this embodiment, to prevent the pulling plate 62 and the locking disc 61 from interfering with each other when the seat portion 21 rotates relative to the mounting base 5, one end of the pulling plate 62 close to the locking disc 61 is provided with an arc-shaped surface 622 matched with the locking disc 61. The locking pin 621 is arranged on the arc-shaped surface 622, and the seat portion 21 is provided with a pulling plate spring matched with the pulling plate 62. The pulling plate spring abuts against the pulling plate 62, thereby enabling the locking pin 621 to insert into the locking groove 611.

Additionally, the locking disc 61 is provided with a swing positioning groove 612. The swing positioning groove 612 is located beside the locking groove 611, and the locking pin 621 interacts with the swing positioning groove 612 in an inserting mode. When the swing dining chair is transformed into a swing state, the locking pin 621 is inserted into the swing positioning groove 612, which effectively prevents the chair body from shaking such that a high stability is ensured.

The seat portion 21 is provided with a second locking device for locking the first locking device. The second locking device comprises a pin hole 71 formed in the pulling plate 62 and a shift pin 72 which is arranged on the seat portion 21 and corresponds to the pulling plate 62. The seat portion 21 is longitudinally provided with a pin sliding groove 212, and the shift pin 72 is longitudinally slidably interacts with the seat portion 21 through the pin sliding groove 212. The seat portion 21 is provided with a pin spring matched with the shift pin 72. When the pin spring abuts against the shift pin 72, the shift pin 72 is inserted into the pin hole 71.

A sliding connection rod 8 is arranged on the seat portion 21 for unlocking the second locking device. The seat portion 21 is transversely provided with a connection rod sliding groove 213, and the sliding connection rod 8 transversely slidably interacts with the seat portion 21 through the connection rod sliding groove 213. To make the movement of the sliding connection rod 8 more stable, the seat portion 21 is provided with a guide post 214, and the sliding connecting rod 8 is provided with a waist-shaped hole 81 in sliding fit with the guide post 214 along the sliding direction of the sliding connection rod 8.

The shift pin 72 is in linkage with the sliding connection rod 8. More specifically, the shift pin 72 is provided with an inserting hole 721 for receiving the end portion of the sliding connection rod 8, and the hole wall of the inserting hole 721 is provided with a pin inclined surface 722. The end portion of the sliding connection rod 8 is provided with a connection rod inclined surface 82 matched with the pin inclined surface 722. When the backrest 22 is adjusted to the swing included-angle stage from the non-swing included-angle stage relative to the seat portion 21, the sliding connection rod 8 moves towards the shift pin 72, and the connection rod inclined surface 82 abuts against the pin inclined surface 722, thereby enabling the shift pin 72 to escape from the pin hole 71.

The sliding connection rod 8 is in linkage with the backrest 22. Specifically, the sliding connection rod 8 is provided with a linkage post 83, and the backrest 22 is provided with a linkage baffle 221. When the backrest 22 is adjusted to the swing included-angle stage from the non-swing included-angle stage relative to the seat portion 21, the linkage baffle 221 abuts against the linkage post 83. In this embodiment, specifically, through pulling the pulling cord and the backrest 22, the backrest 22 rotates relative to the seat portion 21, and the positioning pin 44 moves along the arc-shaped groove 42. When the positioning pin 44 crosses the first non-swing stage groove 452 and approaches the swing stage groove 451, the linkage baffle 221 starts abutting against the linkage post 83. At this point, the backrest 22 propels the sliding connection rod 8 to move, and the sliding connection rod 8 propels the second locking device to unlock the first locking device.

It should be noted that, when the positioning pin 44 moves between a first non-swing positioning groove 612 and a second non-swing positioning groove 612, as staying at the non-swing stage, the linkage baffle 221 does not abut against the linkage post 83, meaning that the sliding connection rod 8 does not move at this time. When the positioning pin 44 moves to the first non-swing stage groove 452 or the second non-swing stage groove 453 from the swing stage groove 451, the linkage baffle 221 no longer imposes a force on the linkage post 83, at which point the sliding connection rod 8 is reset by means of the reverse acting force of the pin spring under the interaction between the pin inclined surface 722 and the connection rod inclined surface 82.

A third locking device interacting with the multi-stage included-angle adjustment device 4 is arranged between the seat portion 21 and the mounting base 5, and the third locking device is in linkage with the mounting base 5. When the first locking device is unlocked, and the seat portion 21 rotates from the first angle position to the second angle position relative to the mounting base 5 (namely, the dining chair state is adjusted to the swing state), the mounting base 5 propels the third locking device to lock the multi-stage included-angle adjustment device 4, thereby fixing the backrest 22 at the swing included-angle stage relative to the seat portion 21.

More specifically, the third locking device comprises a locking button 91 movably arranged on the seat portion 21 and an inclined surface step 92 which is arranged on the mounting base 5 and abuts against the locking button 91, wherein the inclined surface step 92 is configured to be spiral-shaped. One end of the locking button 91 close to the inclined surface step 92 is provided with a spherical surface 911, which allows the inclined surface step 92 to better trigger the locking button 91. The arc-shaped groove 42 of the stage block 41 is provided with a through-hole 46, and the through-hole 46 is formed between the stage groove 45 corresponding to the swing included-angle stage and the stage groove 45 corresponding to the non-swing included-angle stage adjacent to the swing included-angle stage. In this embodiment, the through-hole 46 is formed between the swing stage groove 451 and the first non-swing stage groove 452, and one end of the locking button 91 far away from the inclined surface step 92 is inserted into the through-hole 46.

When the seat portion 21 is adjusted from the first angle position to the second angle position relative to the mounting base 5, the inclined surface step 92 pushes the locking button 91 to move, and the locking button 91 extends out from the through-hole 46, thus locking the positioning pin 44 of the multi-stage included-angle adjustment device 4. The locking button 91 is provided with a button spring for ensuring that the locking button 91 always possesses a motion tendency of unlocking the multi-stage included-angle adjustment device 4.

The operating principle of the present disclosure is the following:

During use, when the seat portion 21 and the backrest 22 stay at the non-swing included-angle stage (namely, staying in the dining chair state), the seat portion 21 stays at the first angle position relative to the mounting base 5. Under the action of the elastic force imposed by the pulling plate spring, the locking pin 621 on the pulling plate 62 is inserted into the locking groove 611. Meanwhile, under the action of the elastic force imposed by the pin spring, the shift pin 72 is also inserted into the pin hole 71 of the pulling plate 62, which enables the locking disc 61 and the pulling plate 62 to stay in a locked state. At this point, the seat portion 21 cannot rotate relative to the mounting base 5, in other words, unable to be transformed into a swing. While the backrest 22 is adjusted from the non-swing included-angle stage to the swing included-angle stage relative to the seat portion 21, the sliding connection rod 8 propels the shift pin 72 to escape from the pin hole 71, thus locking the pulling plate 62. At this time, through pulling the pulling plate 62, the locking pin 621 is separated from the locking groove 611, which allows the seat portion 21 to rotate relative to the mounting base 5, namely, to be transformed into a swing. In the process of adjustment, the seat portion 21 is adjusted from the first angle position to the second angle position relative to the mounting base 5. During the course, the inclined surface step 92 of the mounting base 5 rotates relative to the locking button 91, thus making the inclined surface step 92 impose a pushing force on the locking button 91. In response to that, the end portion of the locking button 91 extends out from the through-hole 46 to lock the positioning pin 44. Thus, even if the pulling cord is pulled again, the backrest 22 cannot be adjusted anymore, ensuring that the backrest 22 and the seat portion 21 form a safe included angle.

The above are merely preferred embodiments of the present disclosure. All equivalent alterations or modifications made according to the structures, features and principles described in the specification of the present disclosure shall fall into the scope of the present disclosure.

What is claimed is:

1. A multi-stage linkage interlocking structure of a swing dining chair, comprising:

swing arms, and a chair body, wherein the chair body comprises:

a seat portion and a backrest, and the seat portion is rotatably connected with the backrest, wherein a multi-stage included-angle adjustment device is arranged between the seat portion and the backrest, and the multi-stage included-angle adjustment device is used for adjusting the position of the backrest relative to the seat portion, thereby enabling the seat portion and the backrest to stay at multiple included-angle stages, wherein the multiple included-angle stages comprise:

a swing included-angle stage and a non-swing included-angle stage, wherein the swing arm is provided with a mounting base, and the seat portion is rotatably connected with the mounting base, wherein the seat portion is configurable in a first angle position and a second angle position relative to the mounting base, wherein a first locking device is arranged between the seat portion and the mounting base for locking the seat portion such that the seat portion is relatively fixed with the mounting base, wherein the seat portion is provided with a second locking device for locking the first locking device, wherein a sliding connection rod is arranged on the seat portion for unlocking the second locking device, and the sliding connection rod is linked with the backrest, wherein when the backrest is adjusted to the swing included-angle stage from the non-swing included-angle stage relative to the seat portion, the backrest propels the sliding connection rod to move such that the sliding connection rod propels the second locking device to unlock the first locking device, wherein a third locking device interacting with the multi-stage included-angle adjustment device is arranged between the seat portion and the mounting base, and the third locking device is in linkage with the mounting base, wherein when the first locking device is unlocked, and the seat portion rotates from the first angle position to the second angle position relative to the mounting base, the mounting base propels the third locking device to lock the multi-stage included-angle adjustment device, thereby fixing the backrest at the swing included-angle stage relative to the seat portion.

2. The multi-stage linkage interlocking structure of the swing dining chair of claim 1, wherein the first locking device comprises:

a locking disc arranged on the mounting base and a pulling plate which is arranged on the seat portion and corresponds to the locking disc, wherein a pulling plate sliding groove is formed in the seat portion, and the pulling plate slidably interacts with the seat portion, wherein the locking disc is provided with a locking groove, and the pulling plate is provided with a locking pin, wherein the seat portion is provided with a pulling plate spring matched with the pulling plate, wherein the pulling plate spring abuts against the pulling plate, thus enabling the locking pin to be inserted into the locking groove.

3. The multi-stage linkage interlocking structure of the swing dining chair of claim 2, wherein the locking disc is provided with a swing positioning groove, wherein the swing positioning groove is located beside the locking groove, and the locking pin interacts with the swing positioning groove in an inserting mode.

4. The multi-stage linkage interlocking structure of the swing dining chair of claim 2, wherein the second locking device comprises a pin hole formed in the pulling plate and a shift pin which is arranged on the seat portion and corresponds to the pulling plate, wherein the shift pin slidably interacts with the seat portion, and the shift pin is linked with the sliding connection rod, wherein the seat portion is provided with a pin spring matched with the shift pin, wherein the pin spring abuts against the shift pin, thus enabling the shift pin to be inserted into the pin hole.

5. The multi-stage linkage interlocking structure of the swing dining chair of claim 4, wherein the shift pin is provided with an inserting hole for receiving an end portion of the sliding connection rod, and a hole wall of the inserting hole is provided with a pin inclined surface, wherein an end portion of the sliding connection rod is provided with a connection rod inclined surface matched with the pin inclined surface, wherein when the backrest is adjusted to the swing included-angle stage from the non-swing included-angle stage relative to the seat portion, the sliding connection rod moves towards the shift pin, and the connection rod inclined surface abuts against the pin inclined surface, thereby enabling the shift pin to escape from the pin hole.

6. The multi-stage linkage interlocking structure of the swing dining chair of claim 1 or 5, wherein the sliding connection rod is provided with a linkage post, and the backrest is provided with a linkage baffle, wherein when the backrest is adjusted to the swing included-angle stage from the non-swing included-angle stage relative to the seat portion, the linkage baffle abuts against the linkage post.

7. The multi-stage linkage interlocking structure of the swing dining chair of claim 1, wherein the third locking device comprises a locking button movably arranged on the seat portion and an inclined surface step which is arranged on the mounting base and abuts against the locking button, wherein when the seat portion is adjusted from the first angle position to the second angle position relative to the mounting base, the inclined surface step pushes the locking button to move, and the locking button extends out from a through-hole, thus locking a positioning pin of the multi-stage included-angle adjustment device, wherein the locking button is provided with a button spring for ensuring that the locking button always possesses a motion tendency of unlocking the multi-stage included-angle adjustment device.

8. The multi-stage linkage interlocking structure of the swing dining chair of claim 7, wherein the multi-stage included-angle adjustment device comprises:

a stage block arranged on the seat portion, and the stage block is provided with an arc-shaped groove matched with a rotating track of the backrest, wherein a positioning block is movably arranged on the backrest, and a positioning pin in sliding fit with the arc-shaped groove is arranged on the positioning block, wherein a groove wall of the arc-shaped groove is provided with a plurality of stage grooves for receiving the positioning pin, and the plurality of stage grooves are arranged at intervals, wherein a positioning block spring is arranged between the positioning block and the backrest, and the positioning block spring is used for ensuring that the positioning pin always possesses a motion tendency of being clamped into at least one of the plurality of stage grooves.

9. The multi-stage linkage interlocking structure of the swing dining chair of claim 8, wherein the arc-shaped groove of the stage block is provided with a through-hole, and the through-hole is formed between a stage groove corresponding to the swing included-angle stage and a stage groove corresponding to the non-swing included-angle stage adjacent to the swing included-angle stage, wherein one end of the locking button far away from the inclined surface step is inserted into the through-hole.

* * * * *